US010271656B2

(12) United States Patent
Frankel et al.

(10) Patent No.: US 10,271,656 B2
(45) Date of Patent: Apr. 30, 2019

(54) FOLDING SOFA WITH WRAP-AROUND SKIRT

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 15/407,657

(22) Filed: Jan. 17, 2017

(65) Prior Publication Data

US 2018/0199718 A1 Jul. 19, 2018

(51) Int. Cl.
*A47C 4/30* (2006.01)
*A47C 4/38* (2006.01)
*A47C 4/48* (2006.01)

(52) U.S. Cl.
CPC ..... *A47C 4/30* (2013.01); *A47C 4/38* (2013.01); *A47C 4/48* (2013.01)

(58) Field of Classification Search
USPC ..... 297/16.1, 35, 219.1, 229
See application file for complete search history.

(56) References Cited

U.S. PATENT DOCUMENTS 1,928,991 A * 10/1933 Bishop ..... A47C 4/30 297/114
1,957,286 A * 5/1934 Olson ..... A47C 4/30 297/45
4,225,179 A * 9/1980 Oltrona Visconti ... A47C 31/02 297/218.1
D307,995 S * 5/1990 Kelldorf ..... D6/610
5,690,380 A * 11/1997 Waters ..... A47C 31/11 297/219.1
6,086,150 A * 7/2000 Scheurer ..... A47C 15/006 297/219.1
6,354,661 B1 * 3/2002 Moss ..... A47C 31/11 297/224
D465,688 S * 11/2002 Hetherington ..... D6/611
6,877,803 B1 * 4/2005 Reese ..... A47C 4/50 297/18
6,951,368 B2 * 10/2005 Self ..... A47C 1/14 297/219.1
7,156,458 B2 * 1/2007 Hanberg ..... A47C 31/113 297/219.1
7,469,962 B2 * 12/2008 Paulin ..... A47C 31/11 297/219.1
7,641,276 B1 * 1/2010 Chen ..... A47C 4/286 297/35
8,746,790 B2 * 6/2014 Beaty Bishop ..... A01K 1/033 297/188.08
2005/0173953 A1 * 8/2005 Riley ..... A47C 31/11 297/228.1

(Continued)

*Primary Examiner* — Jose V Chen
(74) *Attorney, Agent, or Firm* — Merek, Blackmon & Voorhees, LLC

(57) ABSTRACT

A type of folding sofa with a wrap-around skirt, that includes support legs and wherein the main sofa body is made from soft fabric. The main sofa body consists of a one-piece integrated seat, arm rest, and back rest fabric. A skirt is sewn along the back rest wrapping fabric, the arm rest wrapping fabric and the front of the seat fabric. This skirt goes all the way around the sofa to cover the support legs. The lower edge of the skirt is pegged to the front legs and the rear legs on both sides to form a stretched structure.

7 Claims, 4 Drawing Sheets

(56) References Cited

U.S. PATENT DOCUMENTS

| | | | | |
|---|---|---|---|---|
| 2006/0071511 | A1* | 4/2006 | Tseng | A47C 4/28 297/16.1 |
| 2007/0176474 | A1* | 8/2007 | Miller | A47C 31/11 297/224 |
| 2010/0140994 | A1* | 6/2010 | Moore | A47C 31/11 297/227 |
| 2011/0049951 | A1* | 3/2011 | Bettencourt | A47C 31/11 297/229 |
| 2011/0169304 | A1* | 7/2011 | Chen | A47C 4/283 297/35 |
| 2016/0045029 | A1* | 2/2016 | Frankel | A47C 4/06 297/35 |
| 2016/0166062 | A1* | 6/2016 | Lovley, II | A47C 4/286 297/16.1 |

* cited by examiner

FOLDING SOFA WITH WRAP-AROUND SKIRT

BACKGROUND OF THE INVENTION

Field of the Invention

This invention belongs to the field of daily necessities. Specifically, it is a type of folding sofa with a wrap-around skirt. It can be folded into a flat shape and its elastic cloth fabric can wrap-around the support legs of the sofa.

Technical Background

Existing Chinese Application No. 201410405852.9 is a type of folding sofa which consists of leg frames on both sides and the main sofa body, where the leg frames include front legs and rear legs that are movably hinged together. The front legs are longer than the back legs. The longer sections of the front legs form the back-support section of the sofa. The main sofa body is made from soft fabric and consists of a one-piece integrated seat, arm rest, and back rest fabric. The rear of the back-rest fabric is equipped with a back rest wrapping fabric that fixes the back-rest fabric to the back-support sections of the front legs. The outward-facing side of the arm rest fabric is equipped with arm rest wrapping fabric that fixes the arm rest fabric to the upper sections of the rear legs. There is a reinforced cord between the uppermost section of the rear legs and a point on the upper section of the front legs such that the cord is horizontal to the ground when the sofa is opened. This stretched reinforced cord provides support for the arm rest fabric. The seat section of the main sofa body which is directly supported by the front and rear legs is formed when the back-rest fabric and the arm rest fabric are stretched open by opening the sofa. It is very comfortable to sit in. The back rest wrapping fabric and the arm rest wrapping fabric give the invention the feeling of width and size associated with a sofa. Since the main sofa body is supported only by the front and rear legs, the main sofa body fabric can easily lose its shape, especially when a user leaves the seat, thereby affecting the appearance of the sofa. Another shortcoming of this sofa is that its support legs are exposed, giving it an unsightly top-heavy impression, as is shown in FIGS. 6 and 7.

Improving the deficiencies of the existing folding sofa, simulating the shape of a hard support sofa, and creating a comfortable folding sofa are the research objects of this invention.

SUMMARY OF THE INVENTION

The object of this invention is to design a type of folding sofa that has a full wrap-around skirt that hangs below the back rest wrapping fabric, arm rest wrapping fabric and seat fabric.

The technical portion of this invention is realized through the following method: a type of folding sofa that has a full wrap-around skirt, including:

support legs that are the same or symmetrical on both sides as well as a main sofa body.

The support legs include front legs and rear legs that are movably cross-hinged together. The front legs are longer than the rear legs. The longer sections form the back support.

The front legs and the rear legs are integrally fixed together on both sides by link rods to form one piece.

The main sofa body is made from soft fabric and consists of a one-piece integrated seat, arm rest, and back rest fabric.

The rear of the back-rest fabric is equipped with a back rest wrapping fabric that fixes the back-rest fabric to the back-support sections of the front legs. The outward-facing side of the arm rest fabric is equipped with arm rest wrapping fabric that fixes the arm rest fabric to the upper sections of the rear legs.

Its characteristics are:

A skirt is sewn along the back rest wrapping fabric, the arm rest wrapping fabric and the front of the seat fabric. This skirt goes all the way around the sofa to cover the support legs.

The lower edge of the skirt is equipped with four peg points. At each peg point, the skirt is pegged to the front legs and the rear legs on both sides to form a stretched structure.

The link rods between the front legs on both sides consist of a pair of crossed rods. Each end of the rods is riveted to the front legs on both sides. The link rod for the rear legs and the two rear legs form a bent U-shaped frame. The bottom of this U-shaped frame is the link rod linking the rear legs; and it rests on the ground.

Each side of the seat fabric of the main sofa body is equipped with a molding bar. The length of the molding bar is the same as the width of the seat fabric. The front end of the molding bar is strapped to the upper section of the rear leg with fabric tape and the rear end is strapped to the middle section of the front leg with fabric tape.

A reinforced cord runs between the uppermost section of the rear leg and a corresponding position at the front leg on both sides so that the reinforced cord is horizontal to the ground. The arm rest wrapping fabric wraps around this reinforced cord. When the folding sofa is opened to a fixed position, the reinforced cord is stretched tight, supporting the arm rest fabric.

The above mentioned reinforced cords are directly sewn into the arm rest fabric on both sides.

One end of the above mentioned reinforced cord is fixed to the upper section of the rear leg and the other end is fixed to the front leg.

This invention improves on the existing folding soda, making it more practical. The skirt design not only covers the support legs, but also stretches tight the main sofa body. When a user stands up from the seat, the seat will retain its shape. In addition, the shape of the improved folding sofa is in line with users' aesthetic expectations and has the same feeling of weight and size associated with traditional sofas, but it has the features of being lightweight and foldable, meeting the needs of users looking to create homelike comfort for temporary occasions.

BRIEF DESCRIPTION OF THE DRAWINGS

Similar reference characters denote corresponding features consistently throughout the attached drawings. Namely, in the drawings the following reference numbers refer to the following part.

Figure 1:
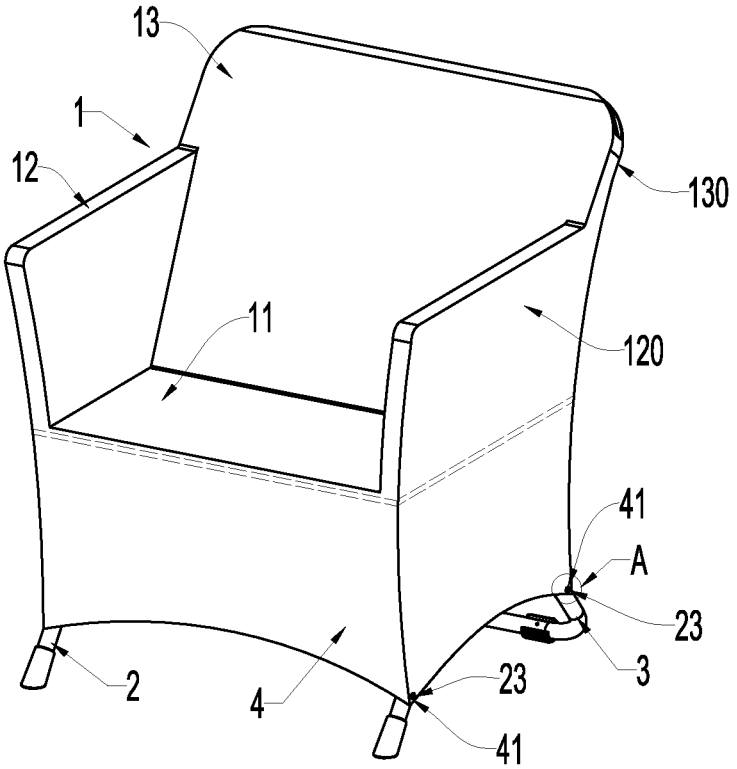
FIG. 1 shows a perspective schematic of the folding sofa with a full wrap-around skirt.
Figure 2:
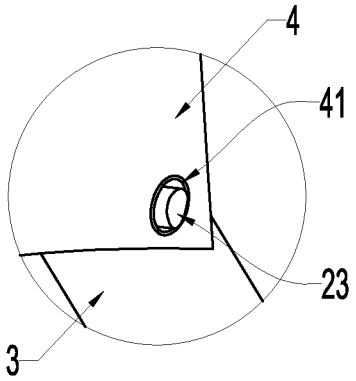
FIG. 2 shows a partially enlarged schematic of Part A in FIG. 1.
Figure 3:
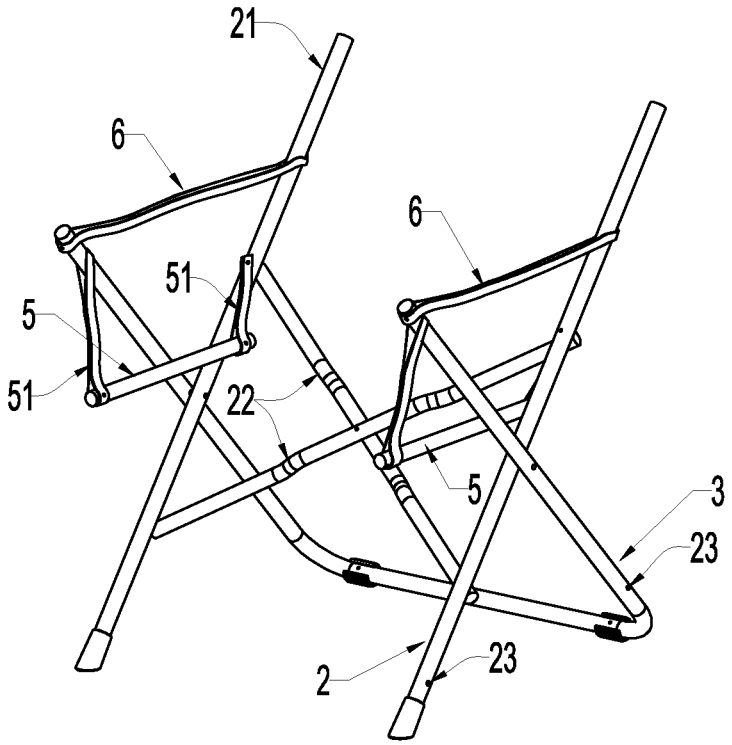
FIG. 3 shows a schematic of the support legs of the folding sofa with a full wrap-around skirt.
Figure 4:
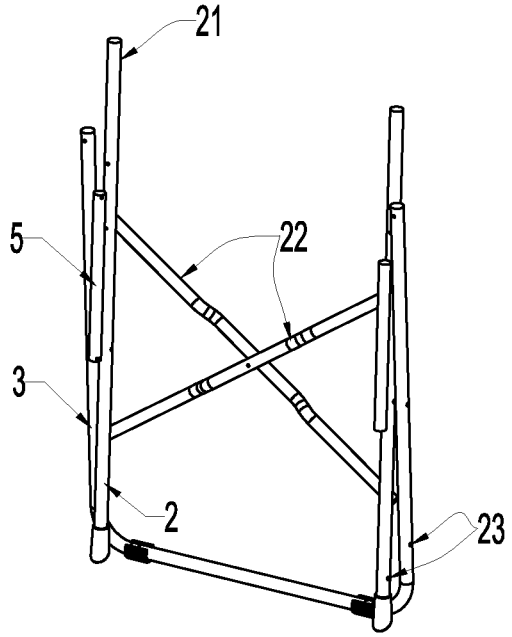
FIG. 4 shows a schematic of the support legs in a folded state.

1—main sofa body
11—seat fabric
12—arm rest fabric
120—arm rest wrapping fabric
13—back rest fabric
130—back rest wrapping fabric
2—front leg
21—back support section
22—bar
23—peg
3—rear leg
4—skirt
41—buckle ring
5—molding bar
51—fabric tape
6—reinforced cord

DETAILED DESCRIPTION OF THE PREFERRED EMBODIMENT(S)

Referring to FIGS. 1 through 4, this folding sofa with full wrap-around skirt includes support legs that are the same or symmetrical on both sides and main sofa body 1.

The support legs include the front legs 2 and the rear legs 3. They are movably cross-hinged together. The front legs 2 are longer than the rear legs 3. The upper sections of front legs 2 forms the back-support section 21. Both sides of the front legs 2 are integrally fixed together on both sides by link rods. The link rods connecting the front legs 2 on both sides are a pair of crossed bars 22. The ends of the bars 22 are riveted to the front legs 2 on both sides, fixing the front legs 2 on both sides into a rigid frame to ensure that the points at which the legs touch the ground and the back-support section 21 do not shift in position after a user sits on the sofa. In addition, the crossed bars 22 allow for a design in which the upper end of back support section 21 has no link bars, making the back-support section 21 softer and more comfortable for sitting.

The rear legs 3 on both sides are integrally fixed together by a link rod. The link rod connecting both sides of the rear legs 3 and the rear legs 3 form a U-shaped frame. The bottom of U-shaped frame is the link rod which rests upon the ground. It is simple, but also ensures greater sofa stability.

The main sofa body is made from a soft fabric with a one-piece integrated seat 11, arm rest 12, and back rest fabric 13. The rear of the back-rest fabric 13 is equipped with a back rest wrapping fabric 130 that fixes the back-rest fabric 13 to the back-support sections 21 of the front legs 2. The outward-facing side of the arm rest fabric 12 is equipped with arm rest wrapping fabric 120 that fixes the arm rest fabric to the upper sections of the rear legs 3. This provides the main sofa body 1 with sufficient support.

Figure 5:
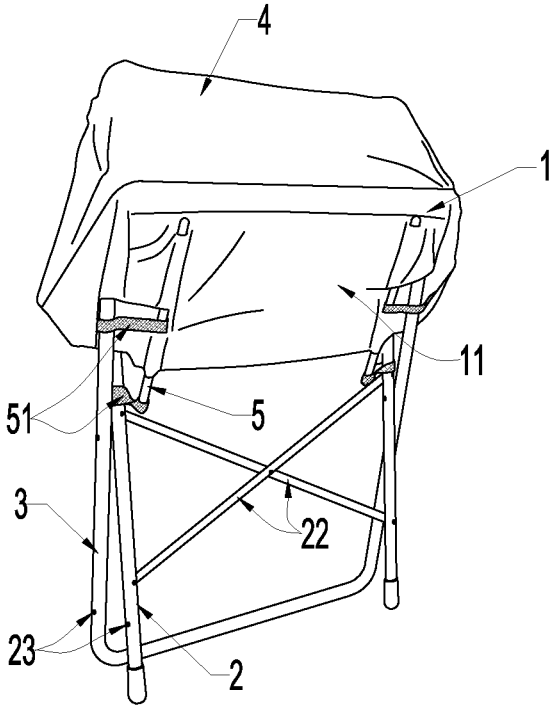
FIG. 5 shows a schematic of the folding sofa in FIG. 1 in a folded state.
Figure 6:
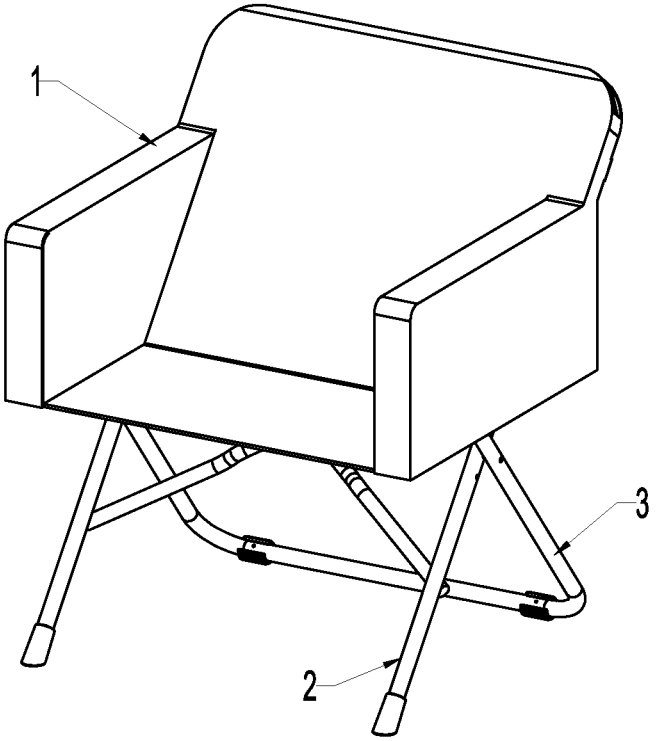
FIG. 6 shows a schematic of the existing folding sofa.
Figure 7:
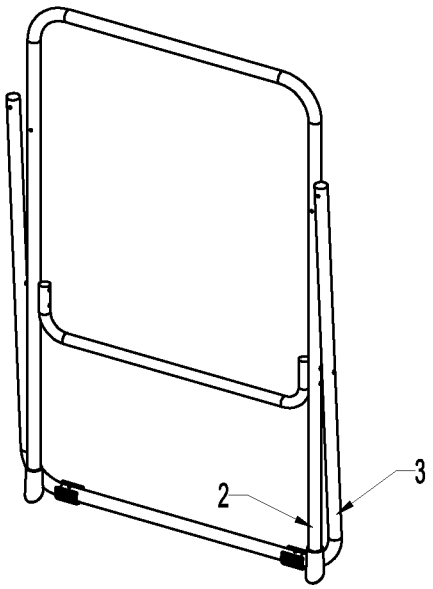
FIG. 7 shows a schematic of the support legs of the existing folding sofa in a folded state.

The skirt 4 hangs below the above mentioned back rest wrapping fabric 130, the arm rest wrapping fabric 120, and the front of the seat fabric 11. This skirt 4 goes all the way around the outside of the support legs. The lower edge of the skirt 4 is buckled to the front legs 2 and rear legs 3 on both sides with four peg points to pull the skirt tight. More specifically, the buckle ring 41 is provided at each peg point on the skirt 4. A peg 23 is provided at the lower section of front legs 2 and rear legs 3. The skirt uses the buckle ring 41 to attach it to the peg 23 to be drawn tight. When the sofa is folded, one can conveniently pull buckle ring 41 off peg 23. Furthermore, it is preferable to make the skirt of elastic fabric. The elasticity of the fabric will maintain the fixed position of the main sofa body 1. When the sofa is folded, the skirt 4 along with the front of the seat fabric can be rolled over the back-support section 21 and be wrapped around the back-support section 21, the front legs 2 and the rear legs 3, holding them in their folded state positions. As a result, no packaging straps are needed, as is shown in FIG. 5.

A molding bar 5 is provided on each side of the seat fabric 11 of the main sofa body. The length of this molding bar 5 is the same as the width of the seat fabric 11. The front end of the molding bar 5 is strapped to the upper section of the rear leg 3 with fabric tape 51 and the rear end is strapped to the middle section of the front leg 2 with fabric tape 51. The molding bars provide support for the sofa and prevent excessive stress on the seat fabric 11 and the armrest fabric 12, which could cause permanent deformation of the fabric. They also maintain the smooth surface of the seat fabric 11.

A reinforced cord 6 runs between the uppermost section of the rear legs 3 and a point on the upper section of the front legs 2 such that the reinforced cord 6 is horizontal to the ground when the sofa is opened. The arm rest wrapping fabric 120 wraps around this reinforced cord 6. When the folding sofa is opened to a fixed position, the reinforced cord 6 is stretched tight, supporting the arm rest fabric 12. This is to say, when a user's arm is placed on the armrest fabric 12, it will not sink. The reinforced cord 6 is sewn into the armrest fabric or one end of it is fixed to the upper section of the rear legs 3 and the other end is fixed to the front legs 2 to form a pull-out structure that can also form the opening angle of the front legs and the back legs, thus reducing the amount of force applied to the armrest fabric 12 and the back-rest fabric 13.

We claim:

1. A folding sofa having a full wrap-around skirt, comprising:

a sofa body including a cover having an integral fabric forming a seat portion, an arm rest portion, a skirt portion and a back rest portion;

a right pair of support legs on a right side of the sofa body including a right front support leg hinged to a right rear support leg, wherein said right front leg is longer than said right rear leg and said right front leg has an extended portion extending above said right rear leg to form a right back support section;

a left pair of support legs on a right side of the sofa body including a left front support leg hinged to a left rear support leg, wherein said left front leg is longer than said left rear leg and said left front leg has an extended portion extending above said left rear leg to form a left back support section;

wherein said right back support section and said left back support section cooperate to form a back support to support the back rest portion of the sofa body cover;

a first link rod connected between said right front leg an said left front leg to form an integral front leg section;

a second link rod connected between said right front leg and said left front leg to form a second integral front leg section, said first link rod being crossed over and hinged to said second link rod to form an X shaped section;

a third link rod connecting between said right rear leg and said left rear leg;

the rear of the back-rest portion is provided with a back rest wrapping fabric that fixes the back-rest portion to the back support section of each of the right and left front legs;

an outward-facing side of the arm rest portion is equipped with an arm rest wrapping fabric that fixes the arm rest portion to an upper section of each of the right and left rear legs;

and a lower edge of the skirt portion is equipped with four peg points, wherein at each peg point the skirt is pegged to a respective one of the right and left front legs and the right and left rear legs to form a stretched structure.

2. The sofa of claim 1, further comprising a buckle ring provided at each peg point on the skirt, each said peg being provided at a lower section of the right legs and the left legs, and wherein the skirt uses the buckle rings to attach the skirt to the pegs to be drawn tight.

3. The sofa of claim 1, further wherein the third link rod forms a bent U-shaped frame with the right rear leg and the left rear leg.

4. The sofa of claim 1, further comprising a molding bar on a left and right side of the seat portion of the sofa body, wherein a length of the molding bar is the same as a width of the seat portion.

5. The sofa of claim 1, wherein a reinforced cord runs between an uppermost section of the right rear leg and a corresponding position at the right front leg and between an uppermost section of the left rear leg and a corresponding position at the left front leg so that the reinforced cord is horizontal to the ground; and the arm rest section of the sofa body cover wraps around the reinforced cord;

wherein when the folding sofa is opened to a fixed position, the reinforced cord is stretched tight, supporting the arm rest portion.

6. The sofa of claim 5, wherein the reinforced cord is directly sewn into the arm rest portion.

7. The sofa of claim 5, wherein one end of the reinforced cord is fixed to the upper section of the right rear leg and the other end is fixed to the right front leg.

* * * * *